United States Patent [19]

Bouchard et al.

[11] 4,130,082

[45] Dec. 19, 1978

[54] FLASHLAMP ASSEMBLY FOR PROVIDING HIGHLY INTENSE AUDIBLE AND VISUAL SIGNALS

[75] Inventors: Andre C. Bouchard, Peabody; Harold H. Hall, Jr., Marblehead; Robert J. Patton, Westford; Thomas J. Sentementes, Wakefield, all of Mass.

[73] Assignee: GTE Sylvania Incorporated, Danvers, Mass.

[21] Appl. No.: 803,565

[22] Filed: Jun. 6, 1977

[51] Int. Cl.[2] ..... G08B 3/14; G08B 7/08

[52] U.S. Cl. ..... 116/5; 116/7; 116/87; 149/31

[58] Field of Search ..... 116/5, 4, 15, 105, 104, 116/101, 7, 2, 85, 86, 87, 88, 89; 340/276, 228, 213, 274; 362/11, 13, 14, 15; 149/31; 102/86.5, 70 R; 431/95 R, 95 A, 93, 92

[56] References Cited

U.S. PATENT DOCUMENTS

| | | | |
|---|---|---|---|
| 627,393 | 6/1899 | Cordes | 149/31 |
| 724,411 | 3/1903 | Muir | 149/31 |
| 775,822 | 11/1904 | Hufnagel | 149/31 |
| 1,329,537 | 2/1920 | Mardick | 149/31 |
| 2,270,226 | 1/1942 | Pease | 116/105 |
| 3,118,798 | 1/1964 | Winckler | 149/31 |
| 3,443,518 | 5/1969 | Cross | 102/24 HC |
| 3,597,604 | 8/1971 | Shaffer | 149/31 |

*Primary Examiner*—S. Clement Swisher
*Assistant Examiner*—Denis E. Corr
*Attorney, Agent, or Firm*—Lawrence R. Fraley

[57] ABSTRACT

A multilamp flashlamp assembly capable of emitting highly intense audible and visual signals and particularly adapted for alarm situations. The assembly utilizes percussive flashlamps which operate in conjunction with a respective plurality of pyrotechnic devices located about the assembly's transparent housing. Each device provides an audible signal in response to the energy received from the respective lamp when the lamp is fired.

42 Claims, 10 Drawing Figures

FLASHLAMP ASSEMBLY FOR PROVIDING HIGHLY INTENSE AUDIBLE AND VISUAL SIGNALS

CROSS-REFERENCE TO COPENDING APPLICATIONS

Two applications, Ser. No. 803,563 and Ser. No. 803,564, were filed June 6, 1977. and are assigned to the assignee of the present application. Ser. No. 803,564 (A. C. Bouchard et. al.), entitled "Activating Mechanism for Flashlamp Article", and Ser. No. 803,563 (R. G. Blaisdell et. al.), entitled "Activation Means for Flashlamp Article", both define various embodiments of activating mechanisms for flashlamp articles. Each of these mechanisms is capable of being used with the flashlamp article of the present invention.

BACKGROUND OF THE INVENTION

The present invention relates to signal assemblies and particularly to signal assemblies which utilize flashlamps. Even more particularly the invention relates to flashlamp signal assemblies which are capable of being used in alarm systems.

It is known in the art to utilize flashlamp signal devices as part of an alarm system. Attention is called to U.S. Pat. Nos. 3,714,647 (A. L. Litman) and 3,805,257 (A. L. Litman et. al.) wherein signal devices are described which incorporate multiple flashlamp elements. The preferred elements for use in these devices are sold under the name "MAGICUBE" and are produced by the assignee of the present invention. Triggering the percussive flashlamps in the above devices is accomplished via a spring-loaded pivotal arm which moves in response to some external activation, e.g. pulling of an attached cord or chain.

In addition to providing a highly intense flash, e.g. 2000 beam candle power seconds, the devices are operatively connected to an electrical circuit which includes therein a photovoltaic cell or similar component which becomes activated upon receipt of the light flash from the fired lamps within the device. As a result, an audible alarm is produced.

A major disadvantage of devices like those above is the requirement for using electrically-operated audible signal generating components. If such a device is incorporated within an alarm system which in turn is electrically connected to normal line current (as in home or industry), the audible portion of the system is inoperative during periods of electrical failure, e.g. "blackouts". If batteries are used instead, the audible portion of the system is operative only when the voltage level of these components is sufficient. It is further necessary to periodically replace these components, which adds appreciably to the overall cost of the system. With devices using electrical circuitry and components, there are also the problems and disadvantages of faulty connections, electrical shock, etc.

Still another problem with alarm systems employing electronic light-activated components spaced from the light source involves the possibility of interruption of the activating light by a window shade, drape, etc. Such interruption of course prohibits subsequent emission of the necessary audible warning.

It is believed therefore that a flashlamp signal device which is capable of emitting both highly intense audible and visual signals in alarm situations and which operates without the need for electrical components and circuitry would constitute an advancement in the art.

OBJECTS AND SUMMARY OF THE INVENTION

It is therefore a primary object of the present invention to enhance the flashlamp signal device art by obviating the disadvantages of previously known devices as described above.

It is a further object of the invention to provide a flashlamp assembly which produces both highly intense audible and visible signals without requiring electrical circuitry and components.

In accordance with one aspect of the invention, there is provided a flashlamp assembly which comprises a flashlamp article and means operatively joined thereto for activating the article. The article includes a housing having at least one flashlamp unit therein and at least one combustible member positioned in operative relationship to each of the flashlamp units. The combustible member provides a highly intense audible signal in response to receipt of the intense flash from the flashlamp.

According to another aspect of the invention, there is provided a flashlamp article which is adapted for being externally activated. The article includes a housing having at least one flashlamp unit therein. At least one combustible member is operatively joined to the flashlamp unit for receiving energy therefrom in the form of light and/or heat and providing an audible alarm of high intensity in response to receipt of this energy.

In accordance with still another aspect of the invention, a combustible member is provided which includes at least one pyrotechnic device. The device in turn includes a container, a quantity of pyrotechnic mixture within the container, and means for sealing the mixture therein. The pyrotechnic device is adapted for being located in operative relationship to a flashlamp unit to receive the intense flash therefrom and provide an audible signal of high intensity in response thereto.

According to yet another aspect of the invention, an activation means is provided for activating the aforementioned flashlamp article. The activation means comprises a casing, seating means for having the article seated thereon, a movable activator within the casing, and means for securing the activation means to an external surface.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
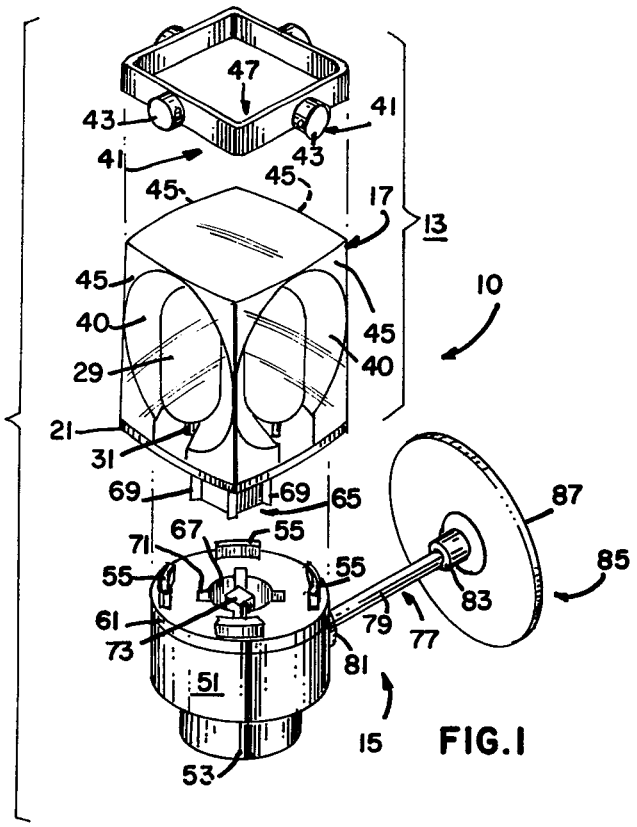
FIG. 1 is an exploded isometric view of a flashlamp assembly in accordance with a preferred embodiment of the invention.
Figure 2:
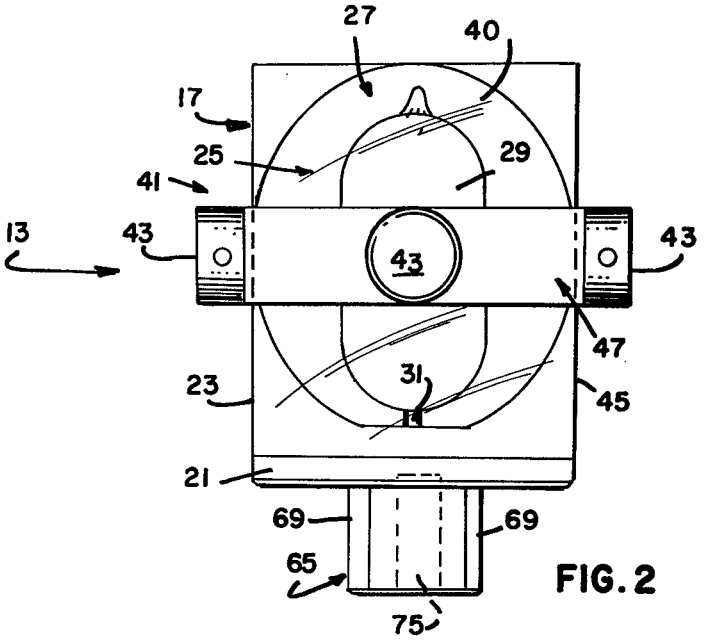
FIG. 2 is a side elevational view of a preferred flashlamp article for use with the flashlamp assembly of FIG. 1.

With particular reference to FIG. 1, there is shown a flashlamp assembly 10 in accordance with a preferred embodiment of the invention. As will be described and shown, assembly 10 is capable of providing both highly intense audible and visual signals and is particularly suited for use in alarm situations. By highly intense audible is meant a signal above approximately 85 decibels at a distance of about 25 centimeters. For purposes of alarm, the function of the audible signal provided by the present invention is to frighten away a prospective intruder in addition to warning the occupants of a residence of said intrusion. The invention, as will be described, is fully capable of emitting highly intense audible signals substantially greater than 100 decibels, for example, 130 to 155 decibels at the described 25 centimeter range. By highly intense visual is meant a visible signal similar to those emitted from known flashbulb and flashcube components. It will be understood from the following description that assembly 10 is capable of using electrically-activated flashbulbs, such components capable of emitting intense light within the range of about 5000 to 20,000 lumen seconds with a peak intensity occurring within a range of about 10 to about 20 milliseconds. These lamps are currently available on the market and sold under the names AG-1, AG-1B, M-2, etc. Another form of electrically-activated lamps which may be used in the present invention are those known in the art as high voltage lamps. These articles are typically electrically joined to a power source such as a piezoelectric crystal, which when deformed, will provide sufficient electrical current to the respective flashlamp to achieve firing thereof.

It is preferred in the present invention to utilize flashlamp components which rely on mechanical activation to achieve firing. One of the best examples of these components is the currently available percussively-ignitable flashlamp used in the well-known multilamp article "MAGICUBE" produced and sold under said name by the assignee of the present invention. An example of this article is defined in U.S. Pat. No. 3,597,604 (J. W. Shaffer), said patent assigned to the assignee of the present invention. The flashlamps used therein typically emit a highly intense visual output of approximately 2000 beam candle power seconds with a peak intensity occurring between 5 and 10 milliseconds.

Assembly 10 comprises a flashlamp article 13 and an activation means 15 which is operatively joined to the article. With reference to FIGS. 1–4, flashlamp article 13 (which is preferably the aforementioned "MAGICUBE" or similar multilamp component) comprises a housing 17 which defines a chamber 19 (FIGS. 3 and 4) therein. Housing 17 includes a base portion 21 and a cover portion 23. At least part and preferably all of cover 23 is light-transmittable to permit the highly intense light generated within housing 17 to pass therethrough. The source of this light for the present invention is at least one flashlamp unit 25 located within chamber 19. Unit 25 includes a percussively-ignitable flashlamp 27 having a light-transmitting envelope 29 and a deformable primer 31 projecting therefrom and preferably mounted within base portion 21. Such flashlamps are well-known in the art, an example described in U.S. Pat. No. 3,535,063 (L. F. Anderson, et. al.). 3,535,063 is also assigned to the assignee of the present invention. Typically, envelope 29 includes therein a combustion-supporting atmosphere, e.g. oxygen, and a quantity of readily combustible material, e.g. shredded zirconium. Deformation of the lamp's primer causes a quantity of fulminating material therein to deflagrate up through the primer's hollow tube and ignite the combustible material within the envelope. This igniting process is otherwise known in the art as "flashing" or "firing" the lamp. Unit 25 further comprises a prestressed helical torsion spring 33 (FIG. 3) positioned adjacent lamp 27 and adapted for striking primer 21 to effect deformation thereof when the spring is activated. Spring 33, typical of helical torsion springs used in the aforementioned "MAGICUBE" component, comprises a pair of segments 34 and 34'. Segment 34 includes a supporting leg 35 (partially shown) at one end thereof while segment 34' includes a striker arm 37 at one end thereof. Supporting leg 35 includes a catch portion 39 to retain striker arm 37 in a prestressed position. Upward displacement of striker arm 37 will in turn release the arm from retention by catch 39 and permit it to swing in direction "a" (FIG. 4) and strike respective primer 31. As will be described, this upward displacement is accomplished using activation means 15 when article 13 is positioned thereon.

When article 13 is used in alarm situations, such as intrusion or burglar alarms, the purpose of providing a highly intense flash is of course to frighten away a prospective intruder. To provide added means for accomplishing this result, in addition to providing means for signaling the occupants of the respective residence that an intrusion is being attempted, the flashlamp article of the present invention further includes at least one combustible member 41 located in operative relationship to flashlamp 27 to receive the energy therefrom in the form of light and/or heat and provide a highly intense audible output in response to this sudden receipt of energy. Combustible member 41 comprises at least one pyrotechnic device 43 located adjacent a respective flashlamp 27. Device 43 is preferably located on an external surface of the light-transmittable cover 23 in line with the centrally located optical axis (not shown) of the lamp. It is understood, however, that this represents only a preferred location for the pyrotechnic device of the invention and that it is only necessary that the device be positioned in such a location that it is able to receive the activating flash from lamp 27. It is also within the scope of the invention to locate device 43 within cover 23 and provide the cover or base portion with at least one aperture to permit escape of the audible signal.

Housing 17 is preferably of the boxlike configuration depicted in FIG. 1 and includes four light-transmittable sides 45. Accordingly, the preferred number of flashlamp units 25 is four with each adapted for emitting highly intense light through a respective side 45. It is also preferred to incorporate an internal reflector 40 with each unit 25. The preferred number of combustible members 41 is four, each member thus located relative to a respective unit 25. With regard to the invention, it is understood that each combustible member 41 may include more than one pryotechnic device 43. On some occasions, as many as four such devices have been satisfactorily employed adjacent a singular respective flashlamp. To facilitate positioning of the various pyrotechnic devices on respective sides 45, member 41 includes a four-sided closed-loop strap 47 on which are spacedly positioned the desired number of devices 43. Strap 47 is adapted for being securedly positioned about cover 23 in the manner shown. A more thorough description of strap 47 and the pyrotechnic devices 43 preferred for use with the invention is provided with the description of FIGS. 5–8.

Figure 4:
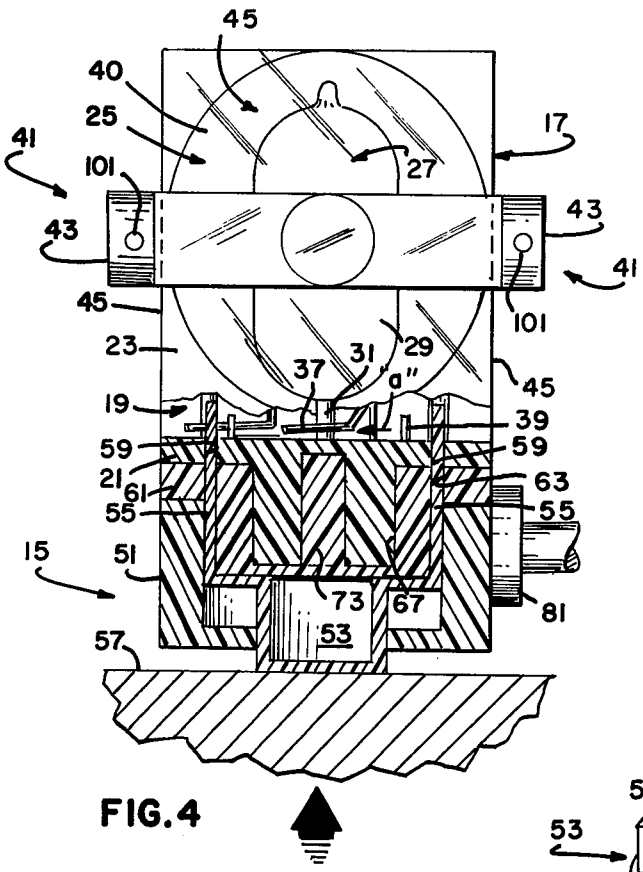
FIGS. 3 and 4 are side elevational views, partly in section, of the assembly of FIG. 1, in operation.
Figure 3:
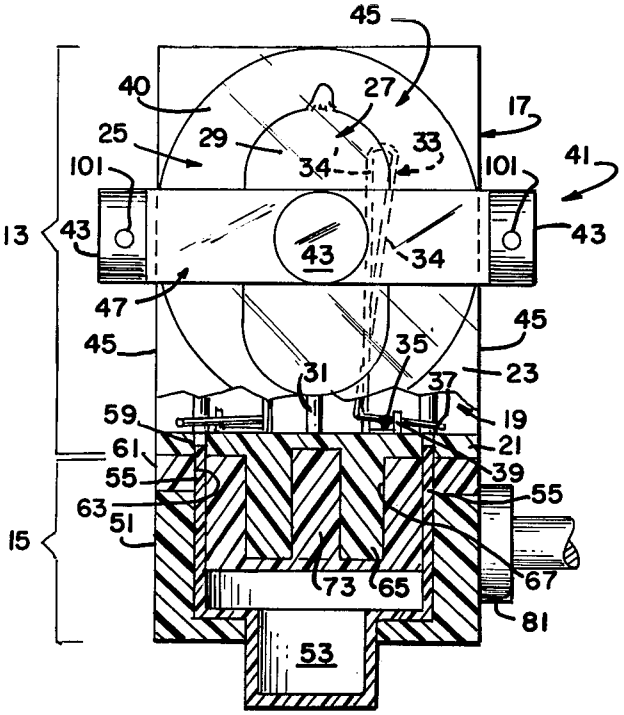
Figure 5:
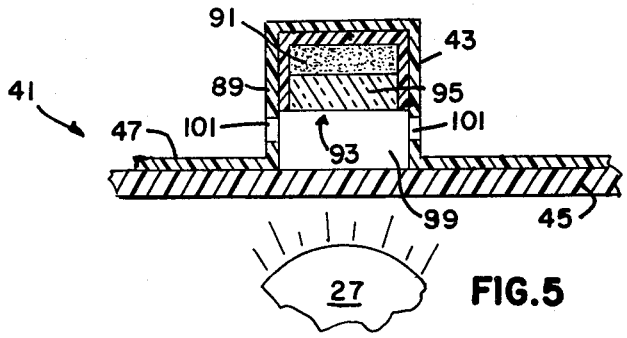
FIGS. 5–8 represent side elevational views, in section of preferred combustible members for use with the assembly of FIG. 1.

Activation means 15 is shown in FIGS. 1, 3, and 4 as comprising a casing member 51 having therein a movable activator 53 which in turn includes a plurality of individual upstanding engagement members 55. Actuation of movable activator 53, as by an externally located upwardly moving window ledge 57, causes each engagement member 55 to pass through a respective opening 59 within base portion 21 and engage torsional striker spring 33. This engagement effects release of striker arm 37 to accomplish the subsequent "firing" of respective lamp 27. Activation means 15 further includes a seating portion 61 positioned at one end of casing 51 and including therein a plurality of apertures 63 each adapted for aligning with a respective opening 59. Accordingly, one of the engagement members 55 will pass through a respective pair of aligned orifices 59 and 63 prior to subsequent engagement of spring 33.

Base portion 21 of housing 17 is shown in FIGS. 3 and 4 as being positively seated within seating portion 61. To facilitate this positioning, base 21 includes a protruding stud portion 65 (also in FIGS. 1 and 2) which inserts within a corresponding opening 67 within the seating portion. Stud portion 65 includes four elongated ribbed leg members 69 (FIF. 1) which mate with four respective longitudinal slots 71 within seating portion 61. It can therefore be seen that article 13 remains stationary when located on the activation means of the invention and is not permitted to rotate thereabout during the firing of lamps 27. To further enhance positioning of article 13, seating portion 61 includes an upstanding alignment member 73 which inserts within a corresponding orifice 75 (FIG. 2) in stud portion 65.

Assembly 10 further includes means 77 for securing the assembly to an external surface, e.g. window or door frame, glass pane, etc. Means 77 comprises an elongated rod 79 affixed at one end 81 to casing 51 and at an opposing end 83 to a retention means 85. According to one embodiment of the invention, retention means 85 comprises a resilient suction cup 87. Means 85 may include a screw (not shown) to provide securement of the assembly or means 85 may simply consist of a rigid flat base to which is secured an adhesive of some type. Furthermore, elongated rod 79 may be L-shaped or similarly bent to accommodate various window and door frame configurations.

It is also within the scope of the invention to provide activation means 15 with a chain or cord which may be affixed to the upper end (toward article 13) of movable activator 53 and to the respective door or window such that opening thereof causes activation of article 13. For example, an opening could be provided in the side of casing 51 toward the top thereof with this chain or cord passing therethrough. Pulling of the chain will in turn cause upward movement of activator 53 and the subsequent actuation of lamps 27.

Figure 4A:
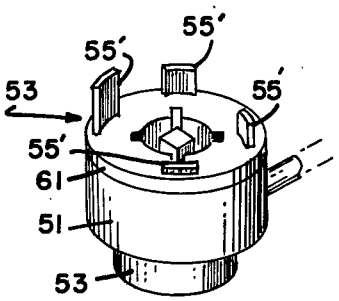
FIG. 4A represents an alternate embodiment of an activation means of the invention.

An alternate embodiment of the invention is shown in FIG. 4A, that being to provide activator 53 with engagement members 55 of varying (or "stepped") lengths. This arrangement permits members 55 to sequentially engage the respective striker arms 37. The total force required to displace arms 37 is thereby equally divided among members 55 such that the force needed to actuate activator 53 is substantially reduced. Understandably, this feature also assures audible and visual signals of longer duration.

With reference to FIGS. 5–8, several combustible members 41 adapted for use with the invention are shown. As previously defined, each member 41 comprises at least one pyrotechnic device 43 which is located in operative relationship to a respective flashlamp 27 to receive the intense energy therefrom in the form of light and/or heat and provide the described highly audible output in response to receipt of this energy. As shown, each pyrotechnic device 43 comprises a container 89, a quantity of pyrotechnic mixture 91 within container 89, and sealing means 93 for hermetically sealing mixture 91 within the container. As shown in FIGS. 5–9, mixture 91 is sealed within the container separate from the flashlamp unit of the invention. An example of container and mixture combination suitable for use in the present invention are available on the market and distributed by The Ohio Art Company, Bryan, Ohio under the name "SUPER BANG CAPS". Each of these caps contains a pyrotechnic composition of potassium chlorate, red phosphorous, manganese dioxide, sand, and glue. The content of each cap is less than 0.20 grains. Pyrotechnic compositions known as "Armstrong's Mixtures" may also be used with the present invention. These compositions typically include potassium chlorate within the range of about 67 to 81 percent, phosphorous from about 8 to 27 percent, sulfur from about 3 to 9 percent, and precipitated chalk from about 3 to 11 percent. All of these percentages are by weight of the total mixture.

The above formulations assure the desired audible output signal within the range of about 130 to 155 decibels as measured at a distance of about 25 centimeters. These formulations are not meant to limit the invention, however, in that other pyrotechnic mixtures are satisfactory, provided each is capable of receiving the intense energy from the flashlamps and providing the highly intense audible signals desired. As an alternate embodiment, it may be desirable to use a pyrotechnic mixture which emits a "whistling" or similar sound. Such compositions are also well known in the art and may contain potassium chlorate, potassium perchlorate, potassium nitrate, red gum, gallic acid, potassium picrate, potassium benzoate, potassium dinitrophenate and sodium salicylate. These formulations are shown on pages 376 and 377 of the book entitled "Military and Civilian Pyrotechnics" by Dr. Herbert Ellern, copyright 1968 by The Chemical Publishing Co., Inc. The aforementioned "Armstrong's Mixtures" are defined on page 353 of this text.

Figure 6:
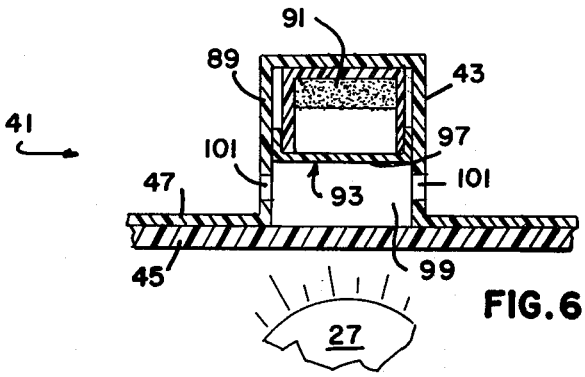
Figure 7:
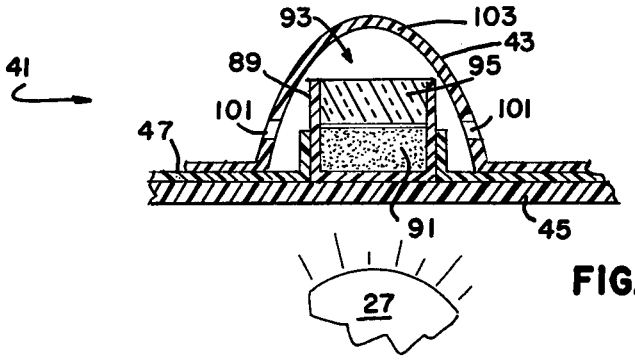
Figure 8:
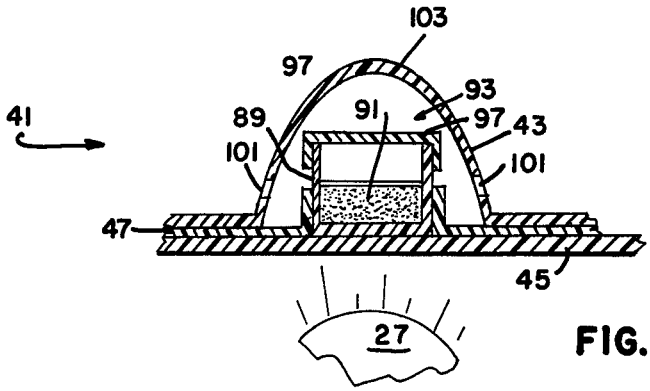

Sealing means 93 is preferably either a sealing material 95 (FIGS. 5 and 7), e.g. epoxy, paraffin, etc., or a thin transparent cap member 97 (FIGS. 6 and 8). The preferred epoxy is clear upon drying while the paraffin is translucent.

Strap 47 is also shown in the drawings as being secured to container 89 to assure the respective positioning relationships depicted. In the event that strap 47 defines a closed chamber 99 (FIGS. 5 and 6) immediately adjacent the light-transmittable side 45 of housing 17 to which strap 47 is secured, it is preferred to provide at least one vent 101 within the strap to permit escape of gases built up by the igniting pyrotechnic. If it is desired to use strap 47 as shown in FIGS. 7 and 8, a separate domed member 103 is used to cover each device 43. Accordingly, member 103 should also contain at least one vent opening 101 therein to permit gas escapement.

It is also within the scope of the invention to utilize a second housing (not shown) which conveniently fits over housing 17 and includes thereon the necessary pyrotechnic devices.

Figure 9:
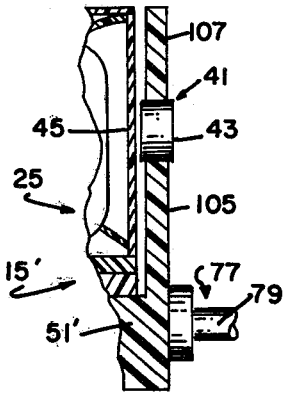
FIG. 9 is a side elevational view illustrating another embodiment of an activation means of the invention.

In FIG. 9 there is shown an activation means 15' in accordance with an alternate embodiment of the invention. Means 15' comprises a casing 51' which includes an upstanding wall portion 105 containing therein a combustible member 41. As previously defined, member 41 includes at least one pyrotechnic device 43. In the embodiment of FIG. 9, wall portion 105 is positioned adjacent housing 17 such that pyrotechnic device 43 is located adjacent flashlamp 27 of unit 25. Light-transmittable side 45 is also shown as is means 77 for securing the assembly to an external surface. As an alternate embodiment to means 77, a quantity of adhesive material (not shown) can be applied to a substantially flat surface 107 of wall 105 and the wall secured to the desired external surface. Rod 79 would therefore not be required.

A preferred material for casing 51, movable activator 53, and seating portion 61 is plastic, e.g. high-impact polystyrene. A preferred material for suction cup 87 is plasticized polyvinyl chloride. The material for strap 47 and container 89 is pigmented polyethlene. The materials preferred for article 13 are similar to those used for the various parts of previously mentioned "MAGICUBE" and are thus well known in the art.

Thus there has been shown and described a flashlamp assembly capable of emitting both audible and visible signals of high intensity. As described, the assembly is relatively easy and inexpensive to manufacture and safe to operate. The assembly is also adapted for use with an external sound detector which may emit a loud and prolonged warning signal when triggered by the present invention.

As described, the invention is highly reliable and eliminates the necessity for electrical circuitry. It is understood however, that electrically-activated flashbulbs could be used with the invention. In this event, activation means 15 could include circuitry therein which is electrically connected to normal line current or casing 51 could contain a battery with sufficient power to trigger the flashbulbs when a switch or corresponding pair of contacts are closed (such as by upward movement of activator 53). It is also understood that the aforementioned high voltage flashlamps which receive electrical activation from a piezoelectric crystal or similar power source can be successfully used in this invention. For example, the upwardly displaced activator 53 could be used to mechanically deform a piezoelectric crystal located within casing 51 to in turn supply the necessary electrical current to such lamps.

While there have been shown and described what are at present considered the preferred embodiments of the invention, it will be obvious to those skilled in the art that various changes and modifications may be made therein without departing from the scope of the invention as defined by the appended claims.

What is claimed is:

1. A combustible member for use with a flashlamp article including at least one flashlamp unit therein, said flashlamp unit including at least one flashlamp, said combustible member comprising:

at least one pyrotechnic device including a container, a quantity of pyrotechnic mixture within said container, and sealing means for hermetically sealing said pyrotechnic mixture within said container separately from said flashlamp unit, said pyrotechnic device adapted for being located externally of and in operative relationship to said flashlamp of said flashlamp unit to receive energy therefrom in the form of light and/or heat and provide an audible signal of high intensity in response to receipt of said energy.

2. The combustible member according to claim 1 wherein said pyrotechnic mixture is comprised of potassium chlorate, red phosphorous, manganese dioxide, sand, and glue.

3. The combustible member according to claim 1 wherein said pyrotechnic mixture is comprised of phosphorous, potassium chlorate, sulfur, and precipated chalk.

4. The combustible member according to claim 1 further including a closed strap member affixed to said container of said pyrotechnic device.

5. The combustible member according to claim 4 wherein the number of pyrotechnic devices is four, said devices spacedly positioned along said closed strap member.

6. The combustible member according to claim 4 wherein said container and said closed strap member are comprised of pigmented polyethylene.

7. The combustible member according to claim 1 wherein said sealing means comprises a sealing material positioned atop said pyrotechnic mixture within said container.

8. The combustible member according to claim 7 wherein said sealing material is selected from the group consisting of epoxy and paraffin.

9. The combustible member according to claim 1 wheren said sealing means comprises a thin membrane affixed to said container.

10. A flashlamp article for providing highly intense audible and visual signals when activated by external activation means, said flashlamp article comprising:

a housing defining a chamber therein and including a base portion and a cover portion, at least part of said cover portion being light-transmittable;

at least one flashlamp unit including a flashlamp positioned within said chamber of said housing adjacent said light-transmittable part of said cover portion, said flashlamp emitting high intensity light through said light-transmittable part of said cover portion when said flashlamp unit is activated by said external activation means; and at least one combustible member located externally of and in operative relationship to said flashlamp unit for receiving energy therefrom in the form of light and/or heat and providing an audible signal of high intensity in response to receipt of said energy, said combustible member being hermetically sealed separately from said flashlamp unit.

11. The flashlamp article according to claim 10 wherein the number of flashlamp units within said chamber is four.

12. The flashlamp article according to claim 11 wherein the number of said combustible members is four.

13. The flashlamp article according to claim 10 wherein said flashlamp unit comprises a percussively-ignitable flashlamp including a light-transmitting envelope and a deformable primer projecting from said envelope, said primer mounted within said base portion of said housing.

14. The flashlamp article according to claim 13 wherein said flashlamp unit further comprises a prestressed torsional striker spring located adjacent said percussively-ignitable flashlamp and adapted for being activated by said external activation means, said striker spring including a striker arm for striking said primer when said spring is activated.

15. The flashlamp article according to claim 14 wherein said base portion of said housing includes at least one opening therein adjacent said torsion striker spring, said activation of said striker spring occurring through said opening.

16. The flashlamp article according to claim 10 wherein said combustible member comprises at least one pyrotechnic device located externally of said housing and adjacent said light-transmittable part of said cover portion.

17. The flashlamp article according to claim 16 wherein said pyrotechnic device comprises a container, a quantity of a pyrotechnic mixture within said container, and sealing means for hermetically sealing said pyrotechnic mixture within said container.

18. The flashlamp article according to claim 17 wherein said combustible member further comprises a closed strap member affixed to said container of said pyrotechnic device, said closed strap member securedly positioned about said cover portion of said housing.

19. Non-rotatable activation means for activating a plurality of flashlamp units located within a flashlamp article, said non-rotatable activation means comprising:

a casing;

seating means located at one end of said casing and adapted for having said flashlamp article stationarily positioned thereon;

an activator member movably oriented within said casing and including a plurality of upstanding engagement members thereon, said activator member moving within said casing and said engagement members passing through said seating means in response to actuation of said activator member by means located externally of said activation means to effect activation of said flashlamp units within said flashlamp article when said article is positioned on said seating means; and means for securing said activation means to an external surface.

20. The activation means according to claim 19 wherein said seating means includes at least one opening therein, said engagement member adapted for passing through said opening prior to activating said flashlamp unit.

21. The activation means according to claim 19 wherein said seating means includes an upstanding alignment member to facilitate positioning of said flashlamp article upon said seating means.

22. The activation means according to claim 19 wherein the number of engagement members is four.

23. The activation means according to claim 22 wherein said engagement members are similar in length.

24. The activation means according to claim 22 wherein each of said engagement members is different in length.

25. The activation means according to claim 19 wherein said means for securing said activation means to an external surface comprises an elongated rod and a retention meas, said rod including a first end secured to said casing and a second end opposing said first end and secured to said retention means.

26. The activation meas according to claim 25 wherein said retention means comprises a resilient suction cup.

27. The activation means according to claim 19 wherein said casing includes an upstanding wall portion having at least one hermetically sealed combustible member located therein, said combustible member adapted for being positioned adjacent said flashlamp unit when said flashlamp article is positioned on said seating means.

28. The activation means according to claim 27 wherein said combustible member comprises at least one pyrotechnic device including a container, a quantity of pyrotechnic mixture within said container, and sealing means for hermetically sealing said pyrotechnic mixture within said container.

29. The activation means according to claim 27 wherein said means for securing said activation means to an external surface comprises a quantity of adhesive material located on said upstanding wall portion of said casing.

30. In combination, a flashlamp assembly for providing highly intense audible and visual signals, said assembly comprising:

a flashlamp article having a housing defining a chamber therein and including a base portion and a cover portion with at least part of said cover portion being light-transmittable, at least one flashlamp unit including a flashlamp positioned within said chamber of said housing adjacent said light-transmittable part of said cover portion for emitting high intensity light through said light-transmittable part of said cover portion, and at least one combustible member located externally of and in operative relationship to said flashlamp for receiving energy therefrom in the form of light and/or heat and providing an audible signal of high intensity in response to receipt of said energy, said combustible member being hermetically sealed separately from said flashlamp unit; and activation means operatively joined to said flashlamp article for activating said flashlamp unit to cause said flashlamp to emit said high intensity light.

31. The flashlamp assembly according to claim 30 wherein said flashlamp of said flashlamp unit is percussively-ignitable and includes a light-transmitting envelope and a deformable primer projecting from said envelope and mounted within said base portion of said housing, said flash lamp unit further comprising a prestressed torsional striker spring located adjacent said flashlamp and including a striker arm for striking said primer when said prestressed striker spring is released, said activation means activating said flashlamp unit by engaging said torsional striker spring to effect said release thereof.

32. The flashlamp assembly according to claim 31 wherein said base portion of said housing includes at least one opening therein adjacent said striker spring, said release of said striker spring occurring through said opening.

33. The flashlamp assembly according to claim 30 wherein said activation means comprises a casing, seating means located at one end of said casing, said base portion of said flashlamp article positioned on said seating means, and an activator member movably oriented within said casing, said activator moving within said casing to activate said flashlamp unit within said flashlamp article in response to actuation of said activator by means located externally of said flashlamp assembly.

34. The flashlamp assembly according to claim 33 wherein said activator includes at least one upstanding engagement member thereon, said engagement member activating said flashlamp unit when said activator moves within said casing.

35. The flashlamp assembly according to claim 33 wherein said base portion of said housing includes a protruding stud portion inserted within said seating means of said activation means, said seating means including an upstanding alignment member inserted within said stud portion.

36. The flashlamp assembly according to claim 30 wherein said combustible member comprises at least one pyrotechnic device including a container, a quantity of pyrotechnic mixture within said container, and sealing means for hermetically sealing said pyrotechnic mixture within said container.

37. The flashlamp assembly according to claim 36 wherein said pyrotechnic device is located externally of said housing and adjacent said light-transmittable part of said cover portion.

38. The flashlamp assembly according to claim 37 wherin said combustible member includes a closed strap member affixed to said container and securedly positioned about said cover portion of said housing.

39. The flashlamp assembly according to claim 37 wherein said activation means includes an upstanding wall portion positioned adjacent said flashlamp article, said pyrotechnic device located within said wall portion.

40. The flashlamp assembly according to claim 39 further including means for securing said flashlamp assembly to an external surface, said securing means comprising a quantity of adhesive material located on said upstanding wall portion of said activation means.

41. The flashlamp assembly according to claim 30 further including means for securing said flashlamp assembly to an external surface, said securing means comprising an elongated rod and a retention means, said rod having a first end secured to said activation means and a second end opposing said first end and secured to said retention means.

42. The flashlamp assembly according to claim 41 wherein said retention means comprises a suction cup.

* * * * *